US006224238B1

(12) United States Patent
Chen

(10) Patent No.: US 6,224,238 B1
(45) Date of Patent: May 1, 2001

(54) LAMP HOLDER FOR TERMINAL ARRANGEMENT FOR CHRISTMAS TREE LIGHT

(76) Inventor: Ching-Chao Chen, No. 511, Sec. 3, Dong Ta Rd., Hsinchu City (TW)

( * ) Notice: Subject to any disclaimer, the term of this patent is extended or adjusted under 35 U.S.C. 154(b) by 0 days.

(21) Appl. No.: 09/428,548

(22) Filed: Oct. 28, 1999

(51) Int. Cl.[7] ..... F21W 121/00
(52) U.S. Cl. ..... 362/226; 439/744; 439/440
(58) Field of Search ..... 362/226, 123, 362/806; 439/744, 746, 436, 437, 438, 439, 440

(56) References Cited

U.S. PATENT DOCUMENTS 5,192,127 * 3/1993 Schaef ..... 362/226
5,278,741 * 1/1994 Ehrman ..... 362/226
5,700,082 * 12/1997 Peng ..... 362/226
6,053,620 * 4/2000 Won ..... 362/226 X

* cited by examiner

*Primary Examiner*—Laura K. Tso
(74) *Attorney, Agent, or Firm*—Varndell & Varndell, PLL

(57) ABSTRACT

A lamp holder and terminal arrangement, which includes a lamp holder, the lamp holder having a front receiving chamber, which holds a bulb, and two separated longitudinal insertion holes, and two terminals extended from a a respective electric wire and respectively inserted into the insertion holes in the lamp holder and electrically connected to the lead-out legs of the bulb, wherein the terminals each have a tubular front receptacle, which receives one lead-out leg of the bulb, the tubular front receptacle having a plurality of dents and inwardly protruded springy retaining portions, which secure the corresponding lead-out leg of the bulb in place, and a plurality of outwardly protruded springy retaining portions respectively engaged into respective retaining notches in the corresponding longitudinal insertion hole in the lamp holder.

2 Claims, 6 Drawing Sheets

LAMP HOLDER FOR TERMINAL ARRANGEMENT FOR CHRISTMAS TREE LIGHT

BACKGROUND AND SUMMARY OF THE INVENTION

The present invention relates to a Christmas tree light, and more specifically to a lamp holder and terminal arrangement for Christmas tree light, which keeps terminals positively positioned in a lamp holder for positive connection with lead-out legs of a bulb.

A regular Christmas tree light, as shown in FIGS. 1 and 2, is generally comprised of a flexible lamp holder, a lamp base mounted in the lamp holder, two terminals fastened to a respective electric wire at one end and mounted in the lamp base inside the lamp holder, and a bulb mounted in the lamp base. The bulb has two lead-out legs inserted into a respective longitudinal through holes in the lamp base and connected to terminals. This structure of Christmas tree light is complicated. If the bulb is a light emitting diode, the lead-out legs of the bulb must be accurately connected to the terminals. If the lead-out legs do not match with the terminals in polarity, electricity can not be connected to the bulb.

According to one aspect of the present invention, a Christmas tree light is comprised of a lamp holder holding a bulb, and two terminals mounted in the lamp holder for conducting electricity to the bulb. According to another aspect of the present invention, each terminal comprises a tubular front receptacle for receiving a respective lead-out leg from the bulb, the tubular front receptacle comprising outwardly protruded retaining portions for positioning in the lamp holder, dents and inwardly protruded retaining portions for securing the corresponding lead-out leg of the bulb in place. According to still another aspect of the present invention, the bulb has a longitudinal plane at the periphery of the base thereof, and the lamp holder has a longitudinally extended plane on the inside wall thereof at one side fitting the plane on the base of the bulb for quick installation of the bulb in the lamp holder.

DETAILED DESCRIPTION OF THE PREFERRED EMBODIMENT

Figure 1:
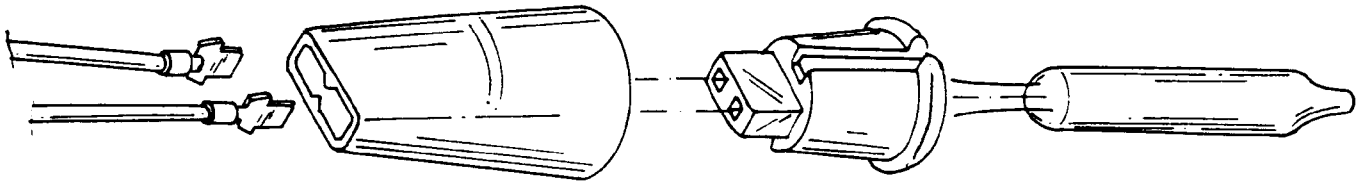
Fig. 1 PRIOR ART
FIG. 1 is an exploded view of a Christmas tree light according to the prior art.
Figure 2:
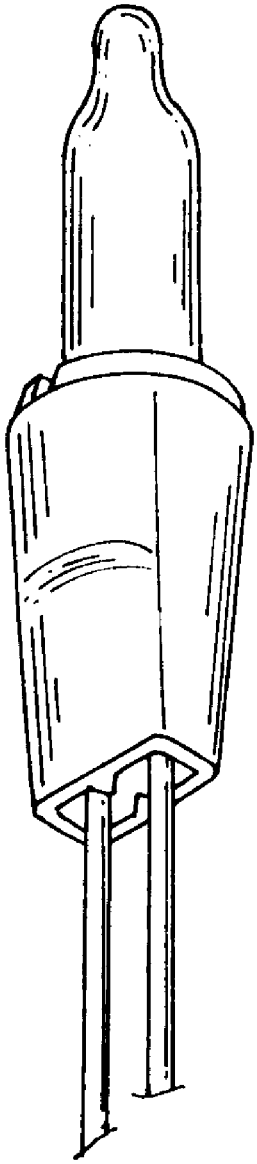
Fig. 2 PRIOR ART
FIG. 2 is an assembly view of FIG. 1.
Figure 3:
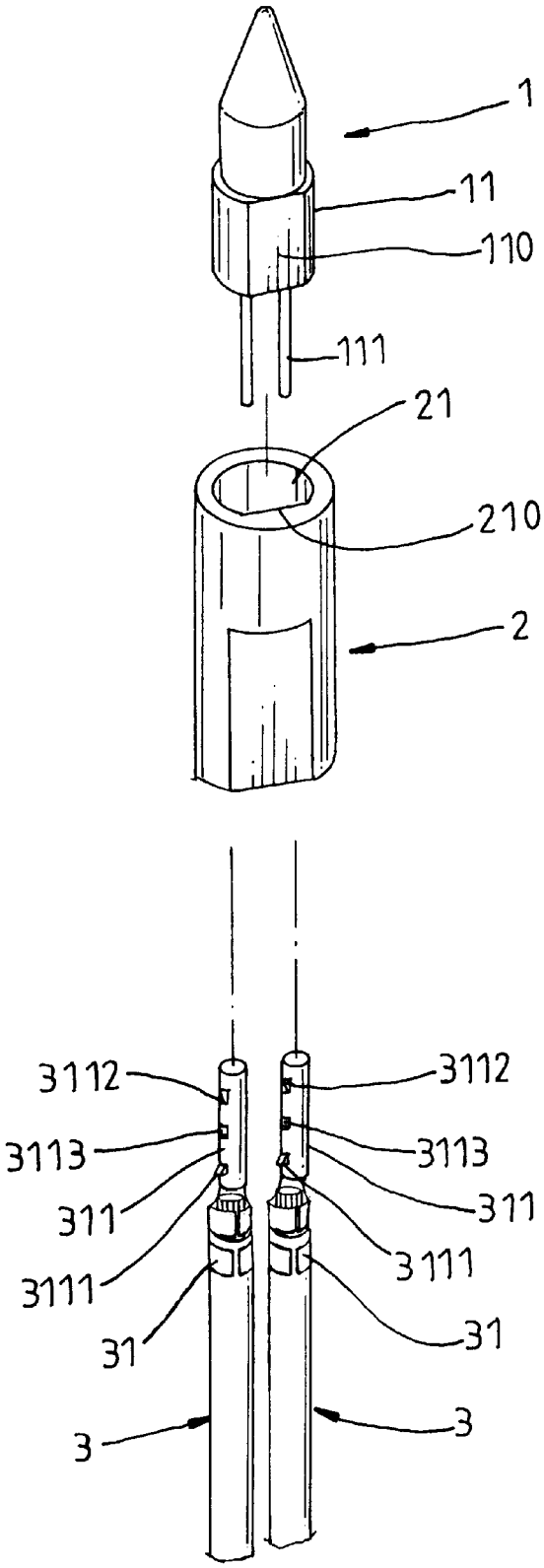
FIG. 3 is an exploded view of the present invention.

Referring to Figures from 3 through 8, the present invention comprises a bulb 1, a lamp holder 2, two electric wires 3, and two terminals 31. The bulb 1 can be a light emitting diode, having a base 11, and two lead-out legs 111 extended out of the base 11. The lamp holder 2 is a flexible, cylindrical member. The terminals 31 are respectively fastened to the electric wires 3 at one end, and respectively electrically connected to the conductors of the electric wires 3. After insertion of the base 11 of the bulb 1 into one end of the lamp holder 2, the conductors are inserted with the electric wires 3 into the opposite end of the lamp holder 2 and respectively electircally connected to the lead-out legs 111 of the bulb 1.

Figure 4:
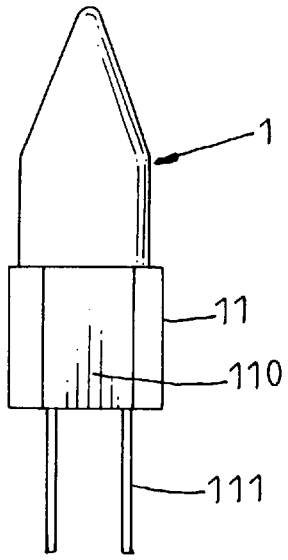
FIG. 4 is a front view in an enlarged scale of the bulb shown in FIG. 3.
Figure 6:
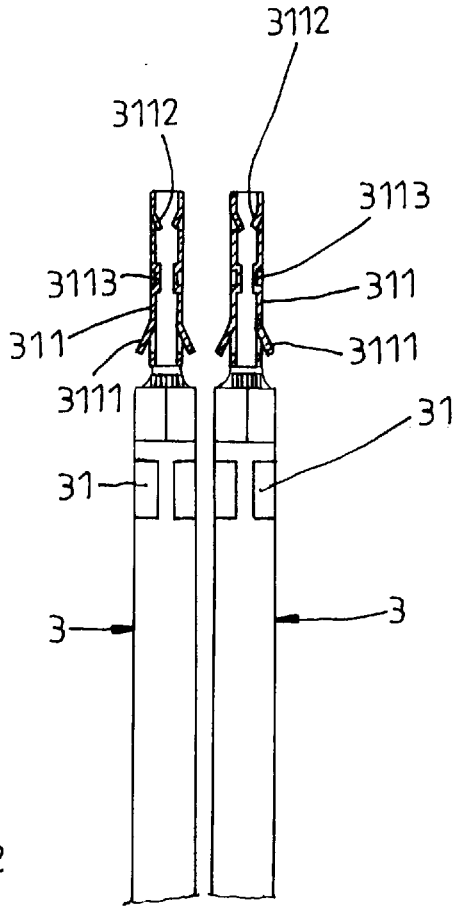
FIG. 6 is a sectional view in an enlarged scale of the electric wires and terminals shown in FIG. 3.
Figure 5:
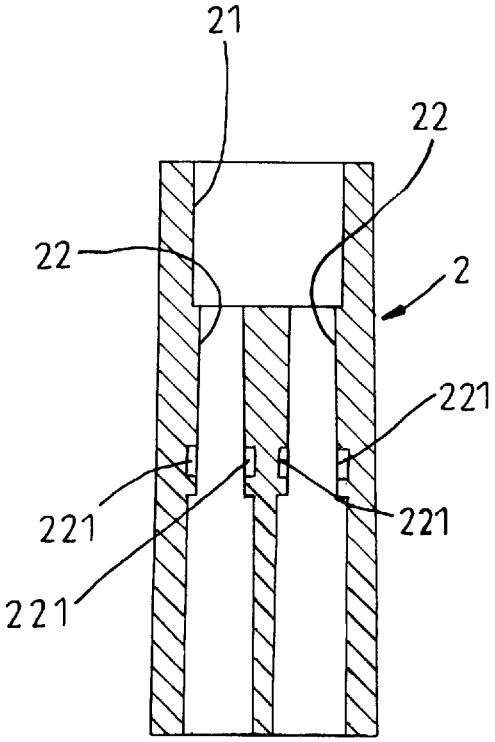
FIG. 5 is a longitudinal view in section in an enlarged scale of the lamp holder shown in FIG. 3.

The lamp holder 2 comprises a receiving chamber 21 at one end, namely, the front end thereof, a plane 210 longitudinally disposed in the receiving chamber 21 at one side, two longitudinal insertion holes 22 separated from each other and respectively extended for the receiving chamber 21 to the other end, namely, the rear end thereof, and two symmetrical pairs of retaining notches 221 respectively bilaterally provided inside the longitudinal insertion holes 22 (see FIG. 5). The base 11 has a plane 110 at the periphery (see FIG. 4). The terminals 31 each comprise a tubular front receptable 311 for receiving the lead-out legs 111 of the bulb 1. The tubular front receptacle 311 of each terminal 31 comprises two dents 3113 bilaterally disposed on the middle, two inwardly protruded springy retaining portions 3112 bilaterally disposed on the inside above the dents 3113, and two outwardly protruded springy retaining portions 3111 bilaterally disposed on the outside below the dents 3113 (see FIGS. 6 and 8).

Figure 7:
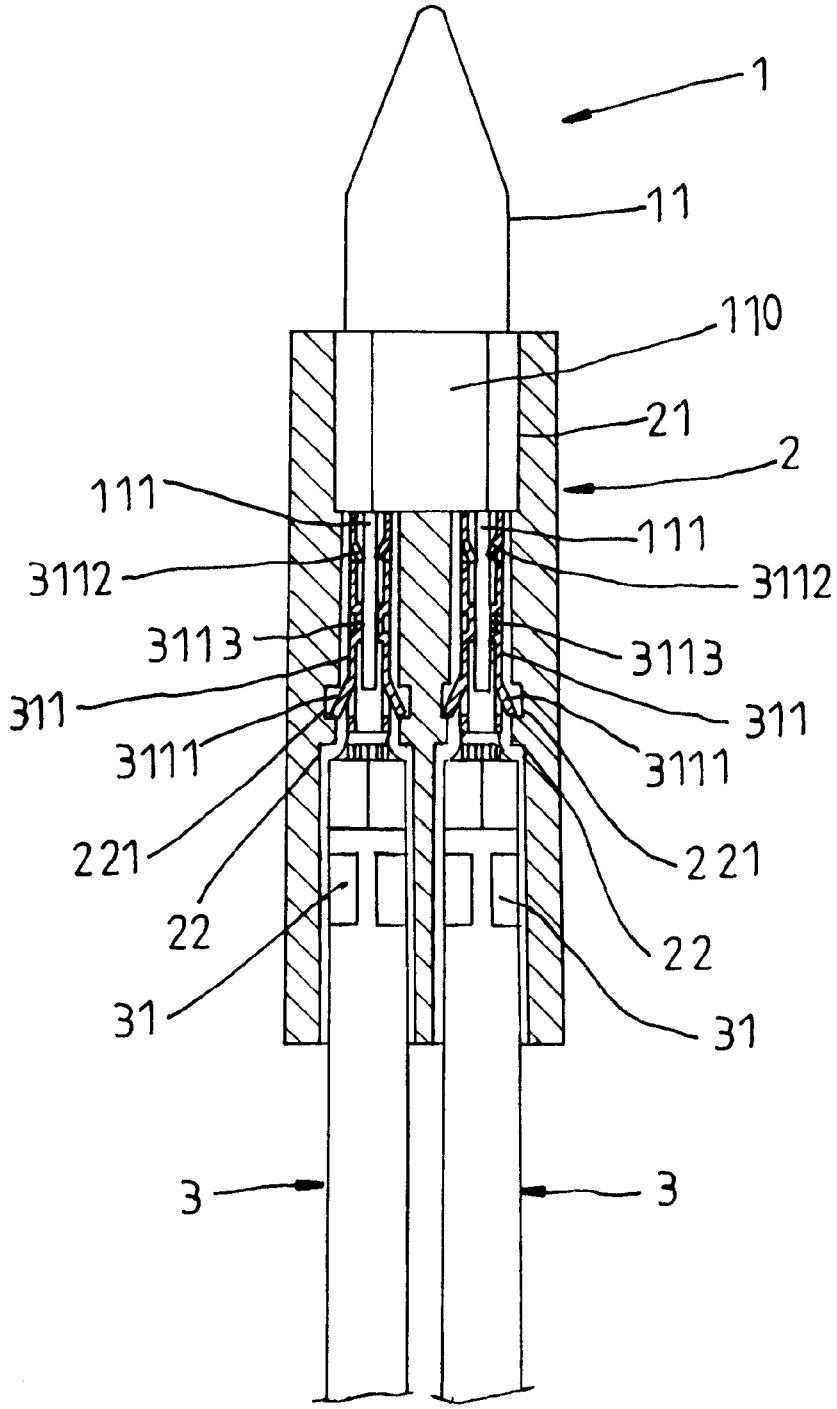
FIG. 7 is a sectional assembly view of the present invention.
Figure 8:
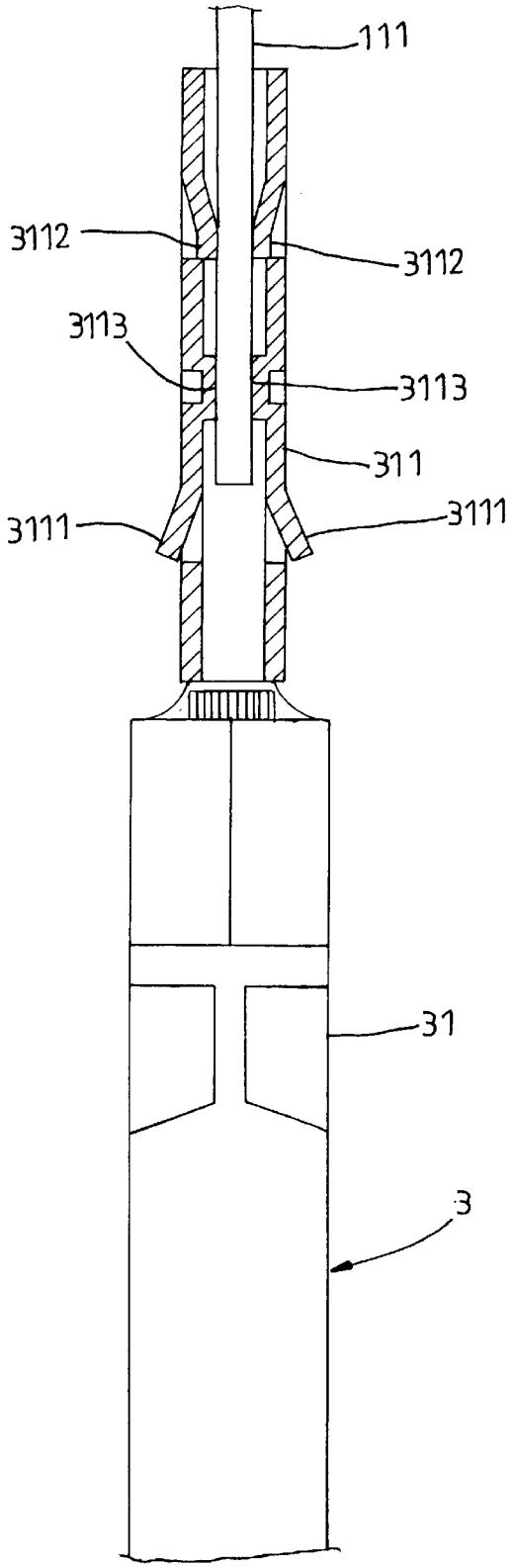
FIG. 8 is a sectional view in an enlarged scale of a part of the present invention, showing the lead-out leg fastened to the terminal at one end of an electric wire.

After insertion of the terminals 31 with the electric wires 3 into the longitudinal insertion holes 22 in the lamp holder 2, the outwardly protruded springy retaining portions 3111 of the terminals 31 are respectively forced into engagement with the retaining notches 221 in the lamp holder 2 to stop the terminals 31 from backward movement relative to the lamp holder 2 (see FIG. 7), and then the base 11 is inserted with the bulb 1 into the receiving chamber 21 in the lamp holder 2, enabling the leat-out legs 111 to be respectively inserted into the tubular front receptacles 311 of the terminals 31 and secured in place by the inwardly protruded springy retaining portions 3112 and the dents 3113 (see FIGS. 7 and 8). The plane 110 at the base 11 fits the plane 210 in the receiving chamber 21 in the lamp holder 2. The base 11 can be inserted into the receiving chamber 21 only when the plane 110 at teh base 11 is aimed at the plane 210 in the receiving chamber 21. Therefore, when the base 11 of the bulb 1 is inserted into the receiving chamber 21 in the lamp holder 2, the lead-out legs 111 are respectively and accurately fastened to the tubular front receptacles 311 of the terminals 31.

As indicated above, the present invention achieves the following advantages.

1. Because the Christmas tree light is comprised of a bulb 1, a lamp holder 2, two terminals 31, and two electric wires 3, the assembly process is simple.

2. Because the tubular front receptacle 311 of each terminal 31 comprises outwardly protruded retaining portions 3111, dents 3113, and inwardly protruded retaining portions 3112, the terminals 31 can easily and positively be positioned in the lamp holder 2, and the lead-out legs 111 of the bulb 1 can positively be connected to the terminals 31.

3. Because the bulb 1 has a longitudinal plane 110 at the periphery of the base 11, and the lamp holder 2 has a longitudinally extended plane 210 on the inside wall thereof at one side fitting the plane 110 on the base 11 of the bulb 1, ther bulb 1 can quickly positioned in the lamp holder 2 and electrically connected to the terminals 31 in correct polarity.

What is claimed is:

1. A lamp holder and terminal arrangement for Christmas tree light, comprising a flexible lamp holder having a front end and a rear end, a bulb mounted in the front end of said flexible lamp holder, said bulb comprising a base and two lead-out legs, two terminals respectively inserted into said lamp holder and connected to the lead-out legs of said bulb to transmit electricity from electric wires to said bulb, wherein:

said lamp holder comprises a receiving chamber in the front end thereof, which receives the base of said bulb, two longitudinal insertion holes separated from each other and respectively extended from said receiving chamber to the rear end thereof, and a plurality of retaining notches respectively provided inside said longitudinal insertion holes;

said terminals each comprise a tubular front receptacle inserted into one longitudinal insertion hole in said lamp holder, which receives one lead-out leg of said bulb respectively, said tubular front receptacle comprising a plurality of dents and inwardly protruded springy retaining portions, which secure the corresponding lead-out leg of said bulb in place, and a plurality of outwardly protruded springy retaining portions disposed on the outside and respectively engaged into the retaining notches in one longitudinal insertion hole in said lamp holder.

2. The lamp holder and terminal arrangement of claim 1 wherein said lamp holder has a plane longitudinally disposed in said receiving chamber, and the base of said bulb has a plane longitudinally disposed at the periphery thereof fitting the plane in said receiving chamber in said lamp holder.

* * * * *